United States Patent [19]

Farmer et al.

[11] 4,227,850

[45] Oct. 14, 1980

[54] LIFT TRUCK LOAD CLAMP FOR HANDLING PAPER ROLLS

[75] Inventors: Stanley E. Farmer, Troutdale; Harry F. Weinert, Portland, both of Oreg.

[73] Assignee: Cascade Corporation, Portland, Oreg.

[21] Appl. No.: 953,093

[22] Filed: Oct. 20, 1978

Related U.S. Application Data

[63] Continuation-in-part of Ser. No. 834,107, Sep. 19, 1977, Pat. No. 4,127,205.

[51] Int. Cl.[3] ..... B66F 9/18

[52] U.S. Cl. ..... 414/620; 92/52; 294/88; 414/911

[58] Field of Search ..... 414/618, 619, 620, 621, 414/730, 739, 740, 741, 911; 294/88; 92/52, 53

[56] References Cited

U.S. PATENT DOCUMENTS

| | | | |
|---|---|---|---|
| 2,815,878 | 12/1957 | Vance | 414/620 |
| 3,269,275 | 8/1966 | Waite | 92/52 |
| 3,896,957 | 7/1975 | Sinclair | 414/620 |
| 3,905,635 | 9/1975 | Esser | 414/621 X |
| 4,127,205 | 11/1978 | Farmer et al. | 414/620 |

*Primary Examiner*—L. J. Paperner

*Attorney, Agent, or Firm*—Chernoff & Vilhauer

[57] ABSTRACT

A paper roll-handling clamp for lift trucks of the pivoted arm type. The pivoting movement of the clamp arms with respect to one another to perform the clamping function is accomplished by use of a generally forwardly extending, selectively extensible and retractible multi-stage telescoping hydraulic piston and cylinder assembly, which gives the clamp arms an exceptionally wide range of motion.

2 Claims, 7 Drawing Figures

FIG. 3
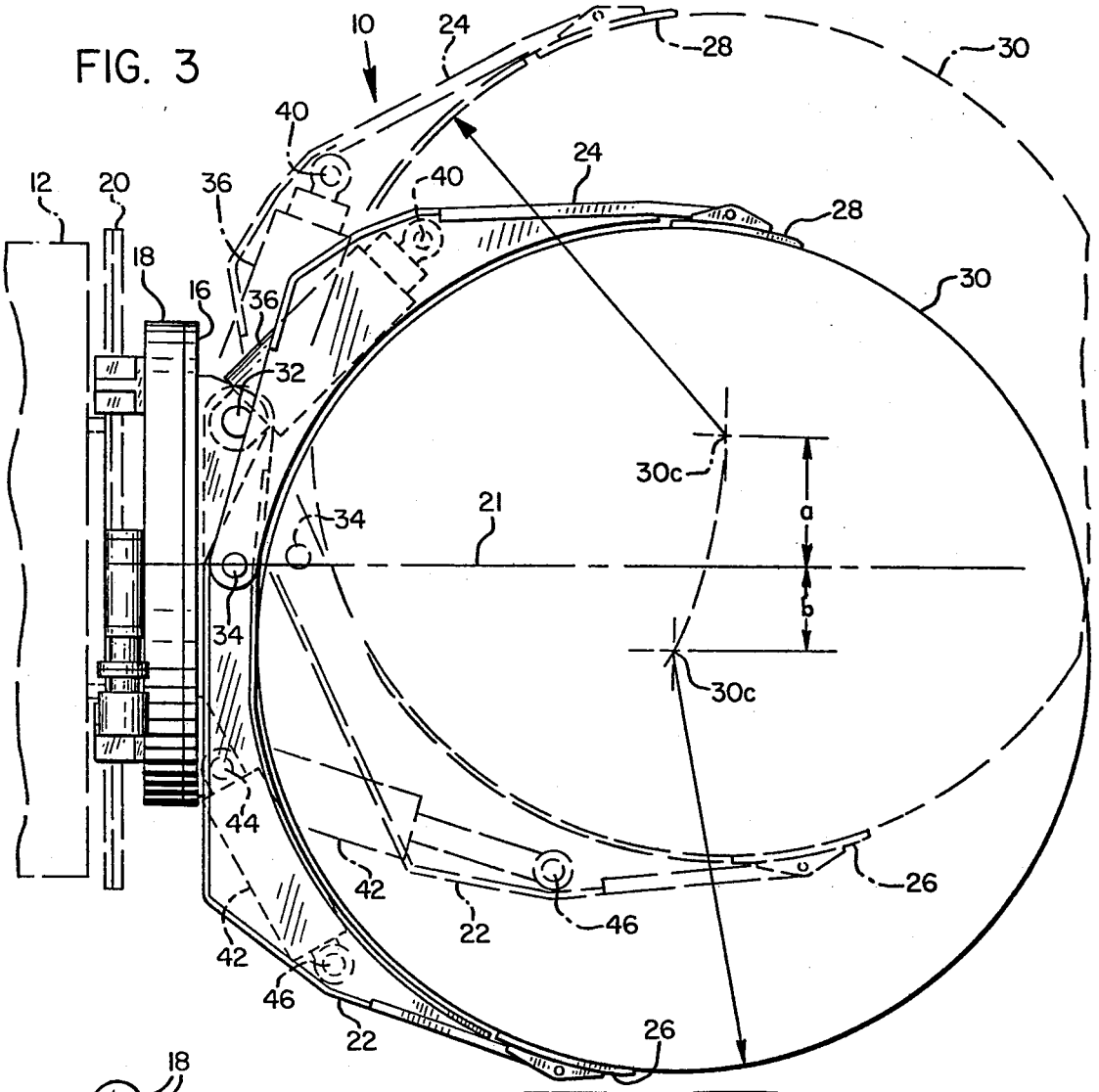
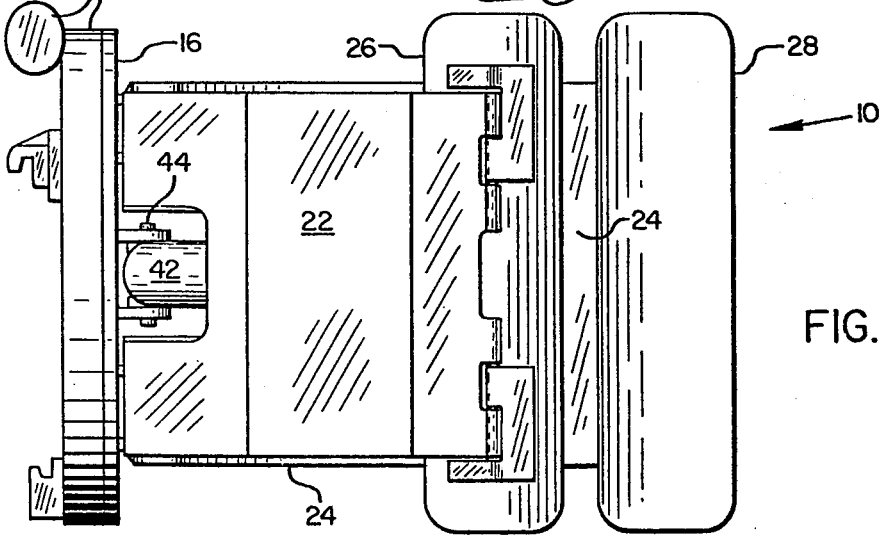
FIG. 4

LIFT TRUCK LOAD CLAMP FOR HANDLING PAPER ROLLS

CROSS-REFERENCE TO OTHER APPLICATIONS

This application is a continuation-in-part of our copending application, Ser. No. 834,107, filed Sept. 19, 1977, now U.S. Pat. No. 4,127,205, which is hereby incorporated herein in its entirety by reference.

BACKGROUND OF THE INVENTION

The present invention relates to improvements in lift truck mounted clamping apparatus for picking up, transporting and stacking large rolls of paper such as newsprint and kraft paper. More particularly the invention relates to improvements in the hydraulic piston and cylinder assemblies utilized to open and close paper roll-handling clamps of the pivoted arm type, as exemplified by Sinclair U.S. Pat. No. 3,896,957 and Esser U.S. Pat. No. 3,905,635.

In the past, it has been recognized that it is necessary for a lift truck mounted paper roll clamp to have the capability of an exceptionally wide range of movement of the clamp arms relative to one another, so that they may be used to engage rolls of paper of widely varying diameter. Ideally, it is in fact desirable for the clamp arms to be able to close completely with respect to one another to pick up scrap paper, as well as to separate sufficiently to carry rolls of paper of the largest diameter, in the range of about sixty inches.

Particularly with clamp arms of the type wherein at least one clamp arm pivots with respect to the other clamp arm to open or close the clamp selectively, achievement of this wide range of movement by means of conventional double-acting piston and cylinder assemblies is difficult because competing design factors peculiar to lift truck paper roll clamps limit the extent to which conventional techniques of maximizing motion from piston and cylinder assemblies can be employed. For example the conventional technique of reducing the length of the lever arm through which the piston and cylinder assembly operates a pivoted clamp arm, to give a greater range of movement of the clamp arm's extremity relative to the linear extension and contraction of the cylinder assembly, results in a lesser clamping force exerted by the clamp arm in the absence of other system changes. Thus, although a relatively short piston and cylinder assembly could be connected by a short lever arm to give a wide range of clamp arm movement, the clamping force available for gripping large, heavy rolls of paper would be reduced.

The hydraulic pressure could theoretically be increased to compensate for the foregoing geometric loss of clamping force, but such a solution is impractical in the field of lift truck load handling attachments which do not have their own integral hydraulic fluid sources but rather must be interchangeably adapted for use with the existing hydraulic systems of lift trucks.

Alternatively, the piston and cylinder assembly diameter might be increased to recover the clamping force lost by the reduction of lever arm length. A larger diameter piston and cylinder assembly however requires a correspondingly thicker clamp arm if the cylinder is to be enclosed at least partially within the clamp arm, as is desirable with clamp arm cylinders of the type which do not extend transversely of the lift truck. A thicker clamp arm is highly disadvantageous when moving rolls of paper which are stacked with their axes vertical, since clearance between these vertically stacked rolls is often small and a thick clamp arm forcibly inserted between adjacent rolls therefore presents a serious risk of scuffing or tearing of the surface layers of paper.

Additional range of clamp arm motion could alternatively be achieved, without presenting the difficulties outlined above, by the use of a longer piston and cylinder assembly, but this produces different space problems. With clamp arm cylinders of the type which do not extend transversely of the lift truck but rather slant in a forward direction, a longer piston and cylinder assembly must be attached to a point located rearward of the pivot point of the clamp arm, as shown for example in Sinclair U.S. Pat. No. 3,896,957. This places the piston and cylinder assembly in the area of the rotating connection between the clamp arms and the elevatable load supporting carriage of the lift truck, which complicates the rotator structure and requires a relatively large forward dimension of the rotator, the latter tending to mount the clamp arms in an excessively forward position decreasing the weight-carrying capacity of a counterbalanced lift truck.

The length of a pivoted clamp arm piston and cylinder assembly of the type which extends transversely of the lift truck, as exemplified by the Esser U.S. Pat. No. 3,905,635, may be maximized in order to maximize the range of clamp arm motion, but the transverse placement of the piston and cylinder assembly inherently tends to require the carrying of the load in an excessively forward position which, as in the previous paragraph, decreases the weight-carrying capacity of a lift truck.

What is required therefore is an improved piston and cylinder structure for maximizing the range of movement of pivoted-type clamp arms without sacrificing needed clamping force or lift truck capacity, without requiring higher than normal hydraulic pressure, and without interfering with the slenderness of the clamp arms or with the space normally occupied by the clamp rotator structure.

SUMMARY OF THE PRESENT INVENTION

The present invention is directed to improvements in lift truck paper roll clamps of the pivoted arm type for the purpose of achieving the foregoing objectives. As in the prior art, the clamp comprises first and second selectively openable and closeable opposing clamp arms, preferably mounted upon a frame which is adapted to rotate about an axis coincident with the longitudinal centerline of the lift truck. Both arms may be pivotally mounted with respect to the frame or, alternatively, one arm may be fixedly mounted on the frame and the other arm pivotally mounted with respect to the frame and fixed arm.

In either case, one of the clamp arms pivots with respect to the other one in the performance of the clamping function about a pivot axis under the influence of a generally forwardly extending telescopic multi-stage extensible and retractible piston and cylinder assembly. Employment of the forwardly extending telescopic multi-stage hydraulic piston and cylinder assembly provides a greater ratio between extended length and collapsed length than is possible with single-stage clamping cylinder assemblies, thereby increasing the range of clamping movement without increasing the collapsed length of the cylinder assembly nor changing the length of lever arm. Thus any interference with the space required for the clamp rotation mechanism, and any sacrificing of lift truck capacity, are avoided.

Equally important, normal hydraulic pressure and cylinder assembly diameter are preserved, the latter serving to maintain the desired slenderness of the clamp arms. The preservation of these parameters does have the effect of sacrificing some clamping force since, when the secondary, smaller diameter telescopic piston of the multi-stage cylinder assembly is extended to bring the extremities of the clamp arms relatively close together, less clamping force is applied than when the primary, larger diameter piston applies the clamping force. However the key to the success of this arrangement is that clamping force is reduced only to the extent that it is not needed, that is, only where the clamp arms are sufficiently close together that they can handle only rolls of correspondingly reduced diameter and weight. For example, inasmuch as the weight of a paper roll is proportional to the square of its diameter, the present apparatus is designed such that, when the larger primary piston extends fully and the secondary, smaller piston assumes the clamping force, the reduction in effective piston face area causes approximately a fifty percent reduction in clamping force but, at this point, roll diameter is approximately one-half of maximum and roll weight is therefore only about one-quarter of maximum. Thus the multi-stage piston and cylinder assembly provides ample clamping force throughout the range of clamp arm separation.

Although the invention will be described in an embodiment having a pair of clamp arms pivotally attached at different points on the frame of the clamp apparatus, it will be apparent to those skilled in the art that the invention is equally applicable where both clamp arms are pivotally attached at the same point, as disclosed in Sinclair U.S. Pat. No. 3,896,957, where only one clamp arm is pivotally mounted to the frame, or in other configurations of pivoted arm clamps.

Accordingly, it is a primary objective of the present invention to provide an improved paper roll handling clamp of the pivoted arm type wherein the range of clamping movement, pursuant to the extension and retraction of a piston and cylinder assembly, is maximized to accommodate rolls of widely varying diameter.

It is a further objective to maximize such range of clamping movement without sacrificing needed clamping force or lift truck capacity, without requiring higher than normal hydraulic pressure to retain needed clamping force, and without interfering with the slenderness of the clamp arms or with the space normally occupied by the clamp rotator structure.

It is a principal feature of the present invention that the clamping function is performed by a selectively extensible and retractible, generally forwardly extending multi-stage hydraulic cylinder and piston assembly.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 3 is a top view of the clamp showing two extremes of shifting movement with respect to a vertical paper roll of a particular diameter.

FIG. 4 is a side view of the clamp rotated 90° from that shown in FIG. 1.

DESCRIPTION OF THE PREFERRED EMBODIMENT

Figure 1:
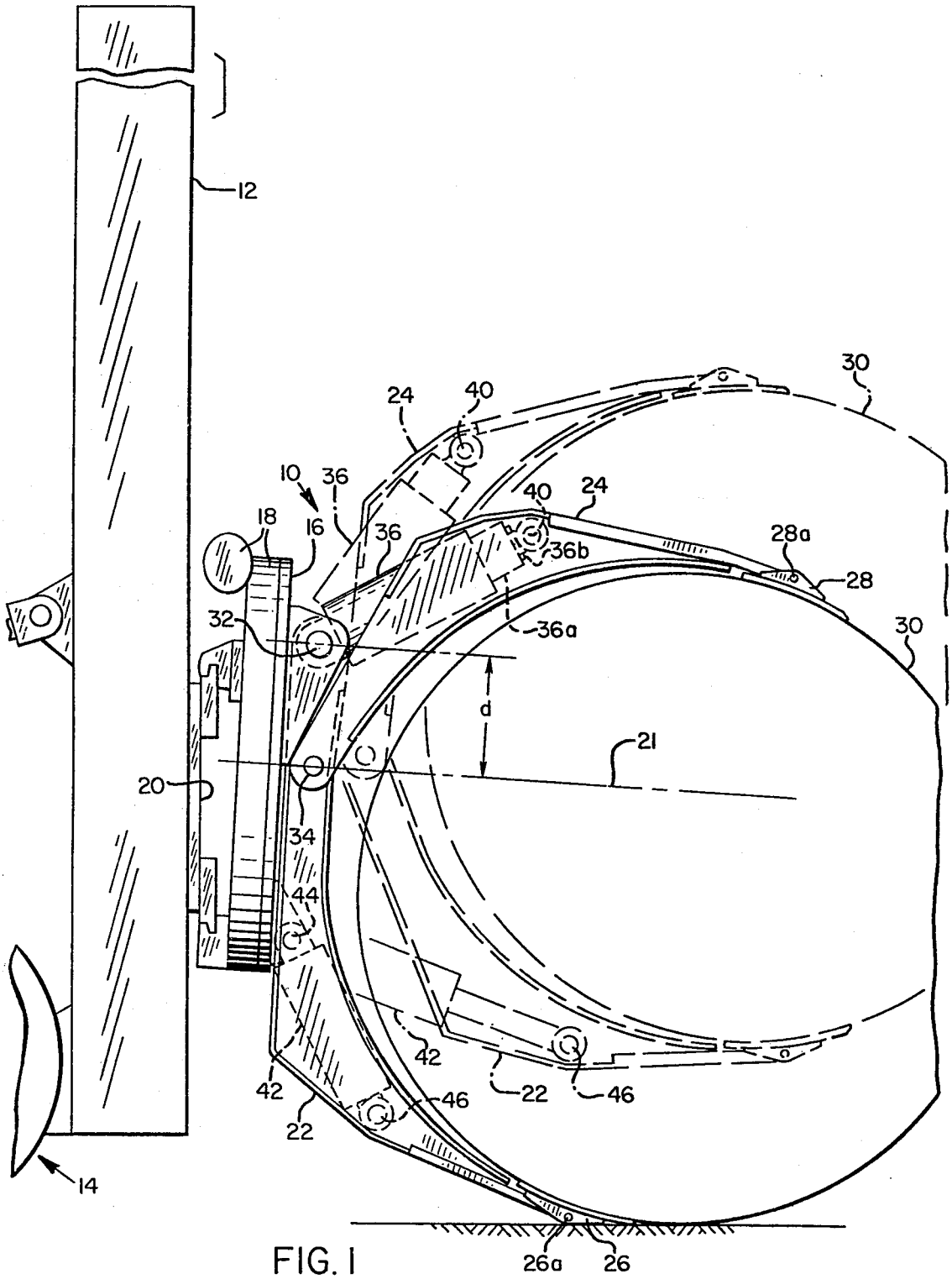
FIG. 1 is a side view of an exemplary embodiment of the paper roll handling clamp of the present invention shown mounted on a lift truck.

With reference to FIG. 1, the paper roll-handling clamp attachment designated generally as 10 is mounted on a mast 12 at the forward end of a lift truck 14. The clamp 10 has a frame 16 which is rotatably mounted by means of a rotator 18 upon a carriage 20 which moves vertically selectively upward or downward on the mast 12. The rotator 18 provides powered rotation of the frame 16 about an axis of rotation 21 extending generally forwardly from the mast 12 and carriage 20 along the longitudinal centerline of the lift truck 14.

Mounted upon the frame 16 are a pair of transversely spaced, forwardly projecting selectively openable and closeable opposing clamp arms 22 and 24 respectively. Each such clamp arm is equipped with a paper roll engaging contact pad 26 and 28 respectively defining the forward ends of the respective clamp arms 22 and 24. The contact pads have opposing concave arcuate surfaces for gripping the cylindrical sides of a paper roll such as 30. Each contact pad 26 and 28 is hingedly connected to the remainder of the clamp arm by a respective hinge **26*a* and 28*a***.

The rear end of the clamp arm 22 is pivotally connected to the frame 16 by a pin 32 offset by a distance d from the axis of rotation 21, forming a pivotal connection having a first transverse pivot axis at that point. Conversely, the rear end of the other clamp arm 24 is pivotally connected to a mid-portion of the clamp arm 22 by a pin 34 at a position between the two ends of the arm 22 spaced away from the first pin 32 by a distance substantially the same as the offset distance d. The pin 34 thus constitutes a second pivotal connection having a second transverse pivot axis connecting the rear end of the arm 24 to the arm 22 at a location nearer to the axis of rotation 21 of the clamp than the first pivot axis.

Figure 5:
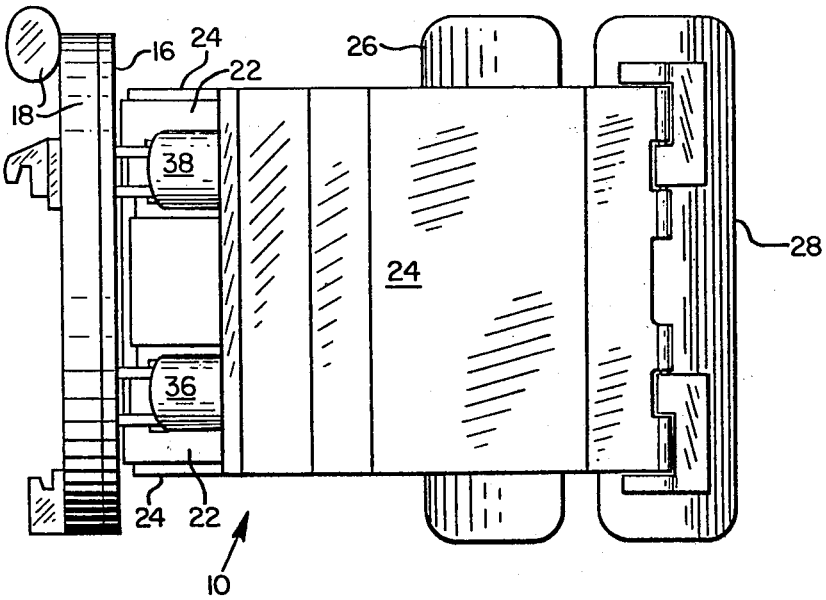
FIG. 5 is a side view of the clamp rotated 180° from that shown in FIG. 4.

To perform the clamping function, the two clamp arms 22 and 24 are movable relative to one another for grasping and releasing paper rolls of varying diameter by the pivoting of clamp arm 24 with respect to clamp arm 22 about the pivot pin 34. Power for such relative clamping movement is furnished by a pair of double stage, selectively extensible and retractible piston and cylinder assemblies 36 and 38 respectively (FIGS. 1 and 5). The piston and cylinder assemblies 36 and 38 are pivotally interconnected at one end thereof with the clamp arm 22 at a location adjacent the frame 16, preferably by the pivot pin 32 so as to pivot relative to the frame about the same pivot axis as the clamp arm 22.

The forward ends of the piston and cylinder assemblies 36 and 38 are pivotally connected to a mid-portion of the clamp arm 24 by a pin such as 40. It will thus be seen that the connection of the piston and cylinder assemblies 36 and 38 forms a triangle having corners defined by the pins 32, 34 and 40 respectively, the leg of the triangle between pins 32 and 40 represented by the piston and cylinder assemblies 36 and 38 being of variable length and thereby determining the pivotal position of the clamp arm 24 relative to the clamp arm 22, which in turn determines the distance between the forward ends of the respective clamp arms. Accordingly, extension of the piston and cylinder assemblies 36 and 38 tends to draw the forward ends of the clamp arms together for clamping a paper roll of any given diameter, while retraction of the assemblies 36 and 38 spreads the clamp arms and releases the roll.

A single piston and cylinder assembly 42, selectively extensible and retractible independently of the piston and cylinder assemblies 36 and 38, is pivotally connected by a pin 44 to the frame 16 and by a pin 46 to a mid-portion of the clamp arm 22. Extension and retraction of the piston and cylinder assembly 42 pivots the clamp arm 22 respectively forwardly and rearwardly about the pivot pin 32 to enable the clamp arm to assume various positions, such as the position shown in dotted lines in FIG. 1.

It will be appreciated that, since the piston and cylinder assemblies 36 and 38 when not actuated define a rigid connection between the clamp arm 24 and the clamp arm 22 (defined by the triangle having the pins 32, 34 and 40 at its corners), movement of the clamp arm 22 in response to extension or retraction of the piston and cylinder assembly 42 about the pin 32 causes a corresponding movement of the clamp arm 24, such that the distance between the forward ends of the two clamp arms remains constant. Thus the clamp arms 22 and 24 may be shifted in unison about the pivot pin 32 despite the fact that the clamp arms pivot with respect to one another about a differently located pivot pin 34.

The pivotal interconnection of the rear ends of the piston and cylinder assemblies 36 and 38 respectively with the clamp arm 22 enables the shifting function of the clamp arms in unison because the triangle 32, 34, 40 is left undisturbed by the pivotal movement of the clamp arm 22. A similar result could be obtained if the rear ends of the piston and cylinder assemblies 36 and 38 were pivotally mounted directly to some portion of the clamp arm 22 at a location adjacent the frame 16 other than the pin 32 such that the pivotal connection would move with the arm 22; however use of the pivot pin 32 about which the clamp arm 22 pivots is preferable because of simplicity and economy.

It is notable that the rear pivotal connection of the piston and cylinder assemblies 36 and 38 which power the clamping function need not in any case be located rearwardly of the pivot pin 32 or frame 16, which would otherwise place the pivotal connection in the area of the rotator 18 causing design problems because of the lack of available space. The double-stage construction of the piston and cylinder assemblies 36 and 38, whereby each assembly has a pair of telescoping pistons such as **36*a* and 36*b* (FIG. 1) within the cylinder, attains this objective by providing substantial extensibility while collapsing to an exceptionally compact size which minimizes the distance which must be provided between the pins 32 and 40** when the clamp arms are at their positions of maximum spread.

It will be appreciated that the two-stage telescoping constructions of the respective piston and cylinder assemblies 36 and 38 provide an extension which is nearly twice that of a single-stage piston and cylinder assembly of the same collapsed length. For the first half of such extension the two-stage assembly exerts a force equal to that of a single-stage assembly having a single piston of a diameter equal to that of the primary piston **36*a*, since during extension of the primary piston 36*a* the secondary piston 36*b* is nested therein as illustrated in FIGS. 1 and 7 and is simply pushed forward by the primary piston. During this stage of extension pressurized fluid is introduced through port 100 (FIG. 7) to the primary piston and, from there, through port 102 to the secondary piston. When the primary piston 36*a* has become fully extended, the secondary piston 36*b* becomes operative and begins to extend as illustrated in FIG. 6, exerting a lesser force because the effective piston-face area is less than that of the primary piston 36*a***.

During retraction, pressurized fluid is introduced through port 104 (FIG. 7) and annular chamber 106 to the upper side of the primary piston **36*a*. The fluid is conducted to the upper side of the secondary piston 36*b* through internal port 108, annular chamber 110 within the wall of the primary piston, and internal port 112**.

Figure 2:
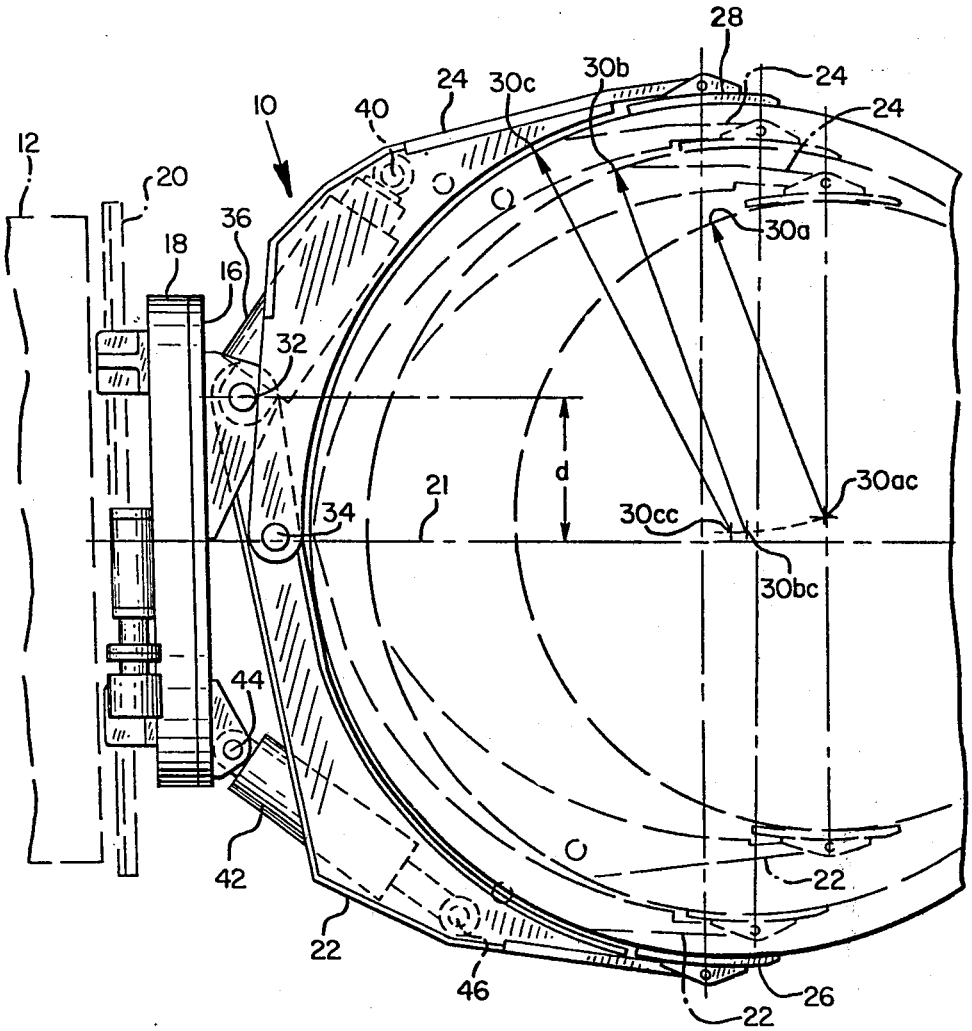
FIG. 2 is a top view of the clamp rotated 90° from the position of FIG. 1 to a position for handling vertical rolls, showing various positions of equal extension of the clamp arms with respect to vertical paper rolls of differing diameters.
Figure 6:
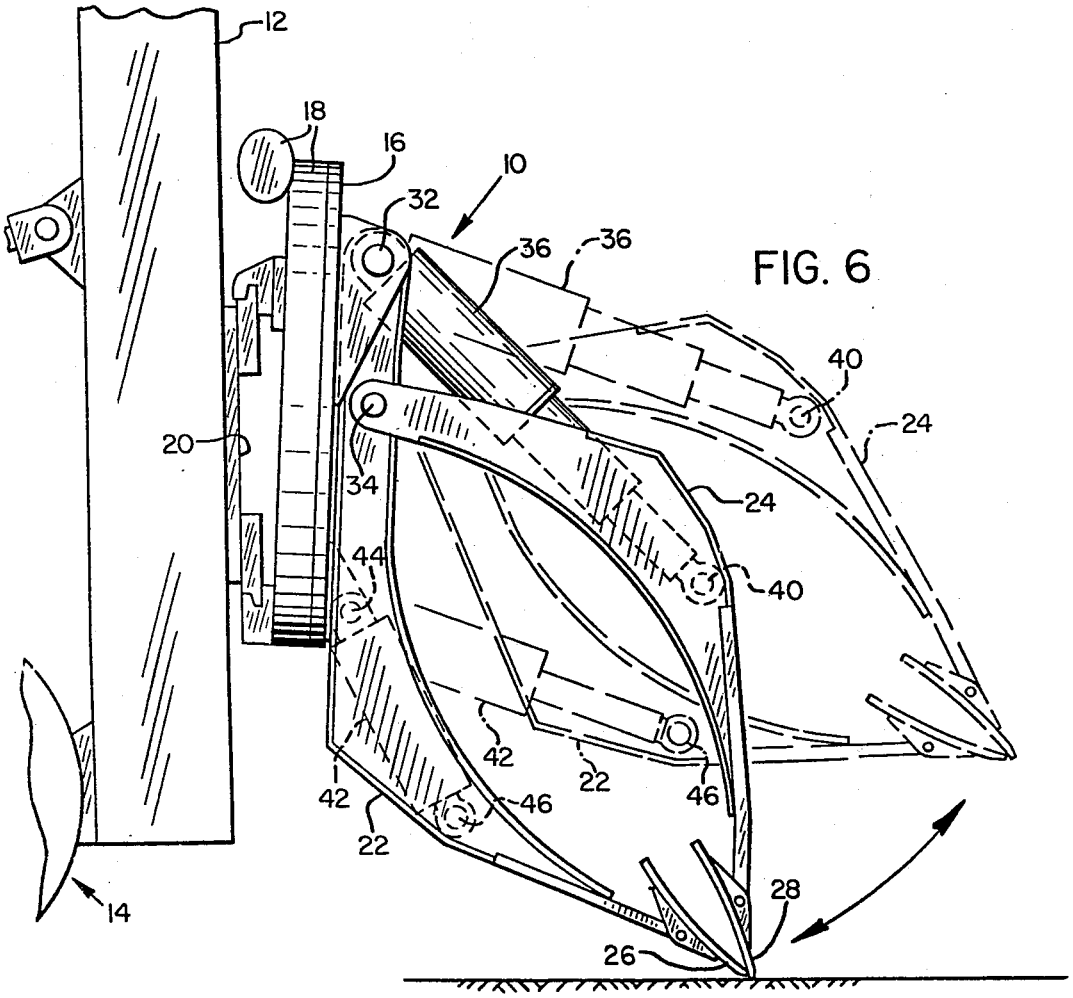
FIG. 6 is a side view of the clamp showing the clamp arms in a completely closed position.
Figure 7:
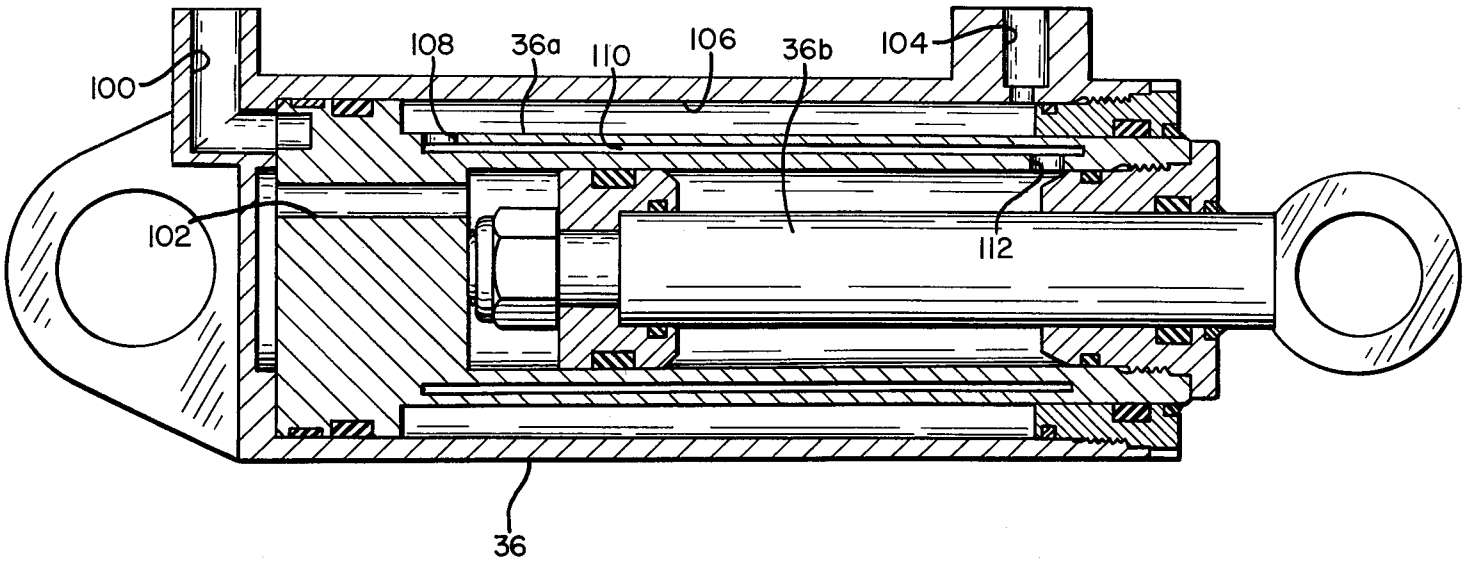
FIG. 7 is a simplified sectional view of an exemplary selectively extensible and retractible multi-stage piston and cylinder assembly suitable for use in the present invention.

For a more complete understanding of the overall operation of the preferred embodiment of the invention shown in the drawings, reference should be made to FIGS. 2, 3 and 6, FIG. 2 shows various positions of equal extension of the clamp arms 22 and 24 with respect to paper rolls **30*a*, 30*b* and 30*c* respectively of differing diameters. Each of these positions of equal extension, wherein the forward end of each clamp arm 22 and 24 extends substantially the same distance forwardly of the clamp frame 16, is achieved by appropriate actuation of the piston and cylinder assemblies 36 and 38 combined with the actuation of the piston and cylinder assembly 42, the assemblies 36 and 38 serving to adjust the distance between the forward ends of the clamp arms to correspond to the diameter of a particular roll and the assembly 42 serving to move the pair of clamp arms in unison to a position where equal extension is achieved. However, whereas in single-pivot point systems equal extension is achieved with the center of the paper rolls (corresponding to the midpoint of the distances between the forward ends of the clamp arms) offset from the axis of rotation 21 by the same distance (such as d) by which the shifting pivot axis is offset from the axis of rotation, in the preferred embodiment the centers 30*ac*, 30*bc* and 30*cc* respectively of the rolls 30*a*, 30*b* and 30*c* are much nearer to the axis of rotation 21 of the clamp than the shifting pivot axis defined by the pin 32. In fact the centers of the rolls of varying diameter at the equal extension positions of the present clamp are nearly coincident with the axis of rotation 21, and thus with the longitudinal centerline of the lift truck. Accordingly vertically oriented rolls of differing diameter impose negligible sideways imbalance, in the equal extension position, upon the lift truck 14 and rotator 18 as a result of the utilization of a pivot axis, corresponding to the pin 34, for the clamping function which is nearer to the axis of rotation 21 than the pivot axis corresponding to the pin 32**, utilized for the shifting function.

The shifting function is illustrated with particular clarity in FIG. 3 wherein the two extremes of shifting motion are illustrated with respect to a particular roll 30 of predetermined diameter. One of the points evident from this figure is that the center 30c of the roll 30 at the two extreme shifting positions shown, which are also positions of unequal extension of the clamp arms, are substantially offset or decentered, by distances a and b respectively, on either side of the axis of rotation 21 of the clamp. This substantial decentration of the rolls in unequal extension positions of the clamp arms is the corollary of the centering of the rolls with respect to the clamp axis of rotation in the positions of equal extension, and is advantageous in the handling of horizontally oriented rolls, for which the positions of unequal extension are primarily used, to provide the stabilizing "pendant" effect whereby the center of mass of the roll hangs below the axis of rotation 21. It is also noteworthy that the decentration distances a and b, at the two extremes of shifting motion, are of similar length on either side of the clamp axis of rotation 21, with no great discrepancy between the extent of shifting to one side and the extent of shifting to the other. This feature, which provides the lift truck operator with maximum lateral maneuverability of vertical rolls to either side of the lift truck longitudinal centerline without movement of the truck, is to be contrasted with single-pivot systems wherein the offset position of the single pivot enables the clamp to shift a vertical roll a great distance from the axis of rotation and longitudinal centerline of the truck in the direction of the offset, but a much smaller distance in the opposite direction thereby severely hampering the versatility of the shifting feature.

A further function of the preferred embodiment of the clamp of the present invention is illustrated in FIG. 6 wherein the substantially complete closeability of the clamp arms and their ability to be shifted in unison in such closed position is illustrated. Such completely closed position is useful for such jobs as picking up large end scrap pieces of paper from paper rolls, which are characteristically discarded in heaps on the floor by the user of the rolls. Such scrap pieces are quite bulky and difficult to handle manually, and it is therefore advantageous that paper roll clamps have such capability for complete closure. It will be noted that such capability requires that the length of the clamp arms, between their forward ends and the point about which they pivot with respect to one another to perform the clamping function, such as pin 34, must be substantially equal.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) first and second selectively openable and closable opposing clamp arms mounted upon said frame projecting therefrom in a forward direction, each of said first and second clamp arms having a forward end and a rear end respectively;

(c) pivotal clamp arm connection means for interconnecting the rear end of said first clamp arm with said frame for permitting said first clamp arm to pivot with respect to said frame selectively toward or away from said second clamp arm;

(d) power means for pivoting said first clamp arm selectively toward or away from said second clamp arm, said power means including selectively extensible and retractable piston and cylinder assembly means pivotally interconnected with said first clamp arm and extending generally rearwardly therefrom toward said frame for causing said first clamp arm to pivot toward said second clamp arm upon extension of said piston and cylinder assembly means;

(e) said piston and cylinder assembly means including at least two telescopically extending pistons within a cylinder, one of said pistons having a larger cross section than the other piston, the larger piston being slidably nested within said cylinder and extensible outwardly from within said cylinder so as to exert a first clamping force on said first clamp arm when said clamp arms are separated from each other by a first distance, and the smaller piston being slidably nested within the larger piston and extensible outwardly from within said larger piston so as to exert a second clamping force on said first clamp arm which is less than said first clamping force when said larger piston is fully extended outwardly from within said cylinder and said clamp arms are separated from each other by a second distance which is less than said first distance, said larger piston having means defining a fluid passageway therein extensible outwardly from within said cylinder in unison with said larger piston for conducting fluid under pressure to said smaller piston for retracting said smaller piston within said larger piston;

(f) said first clamp arm having means defining an enclosure therein and said piston and cylinder assembly means being enclosed at least partially within said enclosure.

2. The load-handling clamp of claim 1 further including rotating means for rotating said frame with respect to said lifting apparatus about a generally forwardly extending axis of rotation.

* * * * *